US008720185B2

(12) United States Patent
Webb et al.

(10) Patent No.: US 8,720,185 B2
(45) Date of Patent: May 13, 2014

(54) USE OF BRAKING ENERGY TO AUGMENT EXHAUST HEAT FOR IMPROVED OPERATION OF EXHAUST AFTERTREATMENT DEVICES

(75) Inventors: Cynthia C. Webb, San Antonio, TX (US); Karl J. Kreder, III, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 141 days.

(21) Appl. No.: 13/406,994

(22) Filed: Feb. 28, 2012

(65) Prior Publication Data

US 2013/0219861 A1 Aug. 29, 2013

(51) Int. Cl.
*F01N 3/00* (2006.01)

(52) U.S. Cl.
USPC ..... 60/274; 60/286; 60/295; 60/300; 60/303; 60/320; 180/65.275; 180/65.31; 180/309

(58) Field of Classification Search
USPC ..... 60/274, 280, 286, 295, 298, 300, 303, 60/320; 180/65.21, 65.275, 65.31, 309
See application file for complete search history.

(56) References Cited

U.S. PATENT DOCUMENTS

| | | | | |
|---|---|---|---|---|
| 6,912,848 | B2 * | 7/2005 | Bedapudi | 60/297 |
| 7,621,120 | B2 * | 11/2009 | Matheaus et al. | 60/274 |
| 8,327,623 | B2 * | 12/2012 | Raman | 60/286 |
| 8,333,066 | B2 * | 12/2012 | Hirose | 60/300 |
| 8,359,844 | B2 * | 1/2013 | Gonze et al. | 60/300 |
| 8,473,177 | B2 * | 6/2013 | Madurai Kumar et al. | 701/101 |
| 8,490,740 | B2 * | 7/2013 | Hashimoto et al. | 180/309 |

* cited by examiner

*Primary Examiner* — Binh Q Tran
(74) *Attorney, Agent, or Firm* — Chowdhury & Georgakis PC; Ann C. livingston

(57) ABSTRACT

A method and system for raising the operating temperature of an emissions control device of an automotive vehicle. A generator converts the vehicle's mechanical braking energy to electrical energy. The electrical energy is delivered, without electrical storage, to an electric heater that heats either the emissions control device or the exhaust gas at the input to the device.

9 Claims, 4 Drawing Sheets

USE OF BRAKING ENERGY TO AUGMENT EXHAUST HEAT FOR IMPROVED OPERATION OF EXHAUST AFTERTREATMENT DEVICES

This invention relates to reducing emissions from vehicles with internal combustion engines, and more particularly to enhancing operation of exhaust aftertreatment devices by using energy generated from vehicle braking activity.

BACKGROUND OF THE INVENTION

Today's vehicle emissions standards call for major reductions in the oxides of nitrogen (NOx) and particulate matter (PM) emissions from diesel and other lean burn engines. To help meet these standards, engine manufacturers have developed engine-based strategies (such as exhaust gas recirculation (EGR) and engine timing modifications), and suppliers have developed improved exhaust aftertreatment devices such as the diesel particulate filter (DPF), selective reduction catalyst (SCR) and lean NOx trap (LNT). These devices are also referred to herein as "emissions control devices" or ECDs.

The use of DPFs for PM control and SCRs and LNTs for NOx control, together with in-cylinder control methods, has reduced tailpipe emissions sufficiently to meet current requirements for heavy-duty vehicles. However, a major application difficulty shared by these aftertreatment devices is that they are temperature-sensitive with a finite temperature window for good operation.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to improving the operation of exhaust aftertreatment devices used in vehicles with internal combustion engines. During braking of the vehicle, braking energy is captured and transformed to heat energy. The heat energy is applied to raise the operating temperature of the aftertreatment device, either by heating the exhaust gas at the input to the device or by heating the device itself.

As indicated in the Background, a DPF provides an effective means for reducing the emission of PM from the tailpipe of a diesel or other lean burn vehicle. The DPF works by trapping the carbonaceous and soluble particulate. When sufficiently high temperature occurs with the DPF, it oxidizes the carbon and hydrocarbons to water and carbon dioxide.

The process of oxidizing the carbon and hydrocarbons trapped on a DPF is called "regeneration". A DPF that uses "passive" regeneration has catalytic material to reduce the temperature needed for oxidation. An advantage of a DPF with passive regeneration is that it may not require active regeneration.

However, the operating temperature of diesel exhaust gas is typically very low. Frequently in practice, the exhaust temperatures are too low to sustain passive oxidation of the PM.

Figure 1:
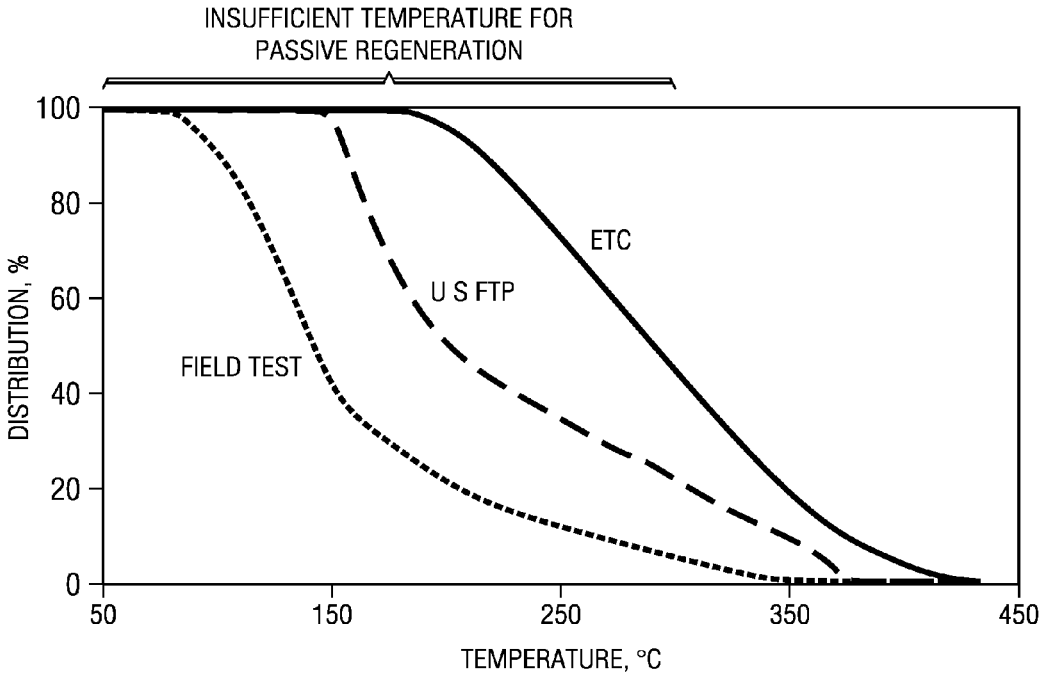
FIG. 1 illustrates examples of exhaust gas temperature distributions in commercial heavy duty diesel vehicles over varying driving applications.

FIG. 1 illustrates examples of exhaust gas temperature distributions in a commercial heavy duty diesel vehicle over varying driving applications. These driving applications include a field test, the federal test procedure (FTP), and European transient cycle (ETC) test. As indicated, for passive regeneration of a catalyzed DPF, these temperatures are often too low.

In real world driving, there are many modes of operation that do not produce sufficient heat to maintain passive regeneration. For the most part, highway operation produces sufficient temperatures to allow the passive control of a filter, however, in low load applications such as urban driving where low speeds, deceleration and idle are dominant driving modes, the exhaust gas temperature can be too low to sustain passive regeneration.

Because a DPF will eventually plug if it is allowed to accumulate PM without regeneration, additional means may be necessary to raise the exhaust gas temperature to achieve regeneration. These "active" regeneration systems provide a means to raise the exhaust gas temperature to heat the trapped PM to a sufficient temperature to achieve regeneration. This is typically done by using various engine management strategies (post fuel injection, intake or exhaust throttling), catalyzed devices (such as diesel oxidation catalysts), fuel combustion or electrical heating.

Figure 2:
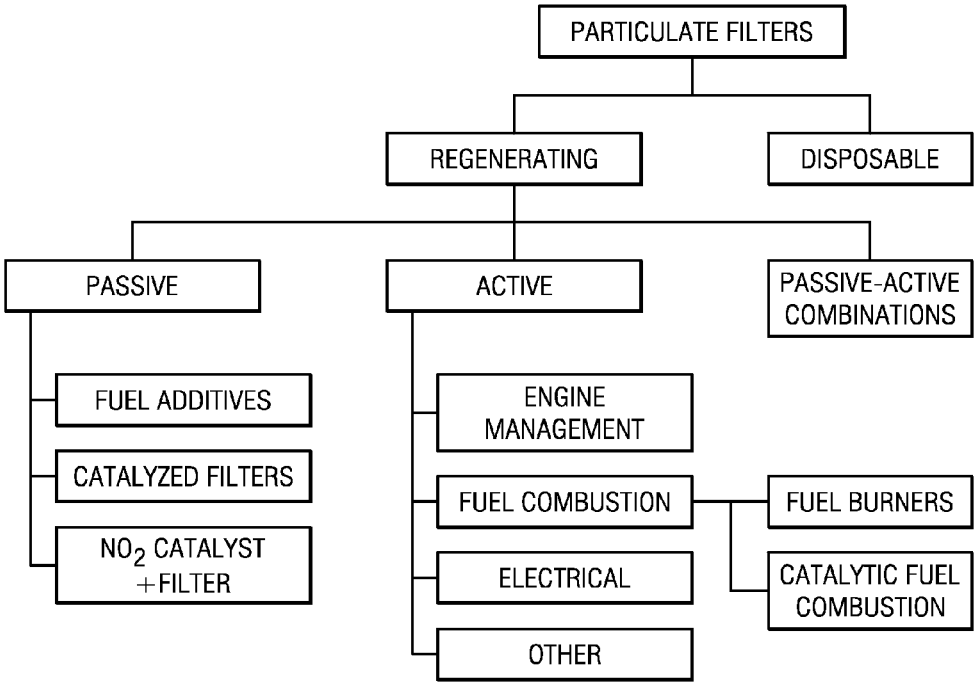
FIG. 2 illustrates various types of DPFs and their operating modes.

FIG. 2 illustrates various types of DPFs and their operating modes. In addition to regenerating DPFs, there are disposable DFPs, which avoid the need for regeneration.

Unfortunately, active regeneration methods require the addition of energy to the exhaust. This requirement is realized by the vehicle operator as a fuel economy penalty. A fuel economy penalty (FEP) has two parts: increased backpressure ($FEP_P$) and the actual consumption of additional energy ($FEP_R$).

$$FEP=FEP_P+FEP_R$$

The fuel economy penalty due to increased engine backpressure ($FEP_P$) can be simply described as:

$$FEPp=(\Delta P/BMEP)\cdot 100\%,$$

where ΔP is the particulate filter pressure drop, and BMEP is the brake mean effective pressure of the engine.

The fuel economy penalty due to energy consumption ($FEP_R$) is a function of the amount of energy required to initiate and sustain regeneration and the efficiency of the selected approach. If the regeneration energy is supplied in the form of an additional quantity of diesel fuel (such as with a fuel burner, in-exhaust injection, or post injection), the fuel economy penalty can be described in terms of the additional fuel energy consumed:

$$FEP_R = DC \cdot (1 + (((\lambda^* stoich + 1) \cdot Cp \cdot \Delta t)/LHV) \cdot \eta,$$

where DC is the duration of active regeneration as a percentage of duty cycle (%), Cp is the specific heat of exhaust gas (kJ/kgK), Δt is the required temperature increase of exhaust gas (K), LHV is the lower heating value of fuel, and η is the efficiency of conversion of chemical energy to heat energy at the catalyst.

The two components of fuel economy penalty are related to each other. Specifically, an increase in regeneration frequency decreases backpressure.

NOx aftertreatment devices, such as SCRs and LNTs, are also temperature sensitive. As with DPFs, it is difficult to maintain their optimal temperature window of operation for all driving, particularly urban driving.

Because exhaust aftertreatment devices must operate continually, unless their active temperature window is maintained throughout all operation, efficiency of the device will quickly drop off. If the temperature is too low, and one of the conventional means to increase temperature is used, the additional energy will be realized as a fuel economy penalty. The magnitude of the penalty will be related to the increase in temperature required.

An underlying principle of the methods described herein is to increase the overall energy of the exhaust, particularly during urban driving, by recovering energy lost during braking and returning that energy to exhaust. This approach increases the average energy of the exhaust, and thereby facilitates passive exhaust aftertreatment system operation, particularly during light load driving. Using brake energy (waste energy) to increase the energy of the exhaust reduces the fuel economy penalty associated with regeneration and operating temperature window management by elevating the overall average temperature of operation. Additionally, elevating the exhaust gas temperature will improve the efficiency of catalytic EDCs and may reduce or remove the need for active regeneration. The most appropriate application of this approach is urban driving.

Large diesel fleet vehicles (such as buses and delivery trucks) consume a major portion of their usable energy as braking energy due to stop and go operation in city driving. Each deceleration event typically is also a fuel cut event resulting in exhaust cooling. Thus, these vehicles provide an excellent platform for the methods described herein.

For example, the total energy consumed and total braking energy realized on the New York City Cycle (NYCC) for a 1500 kg vehicle may be modeled by computer. For the NYCC, braking energy totals 33% of the total energy consumed.

Figure 3:
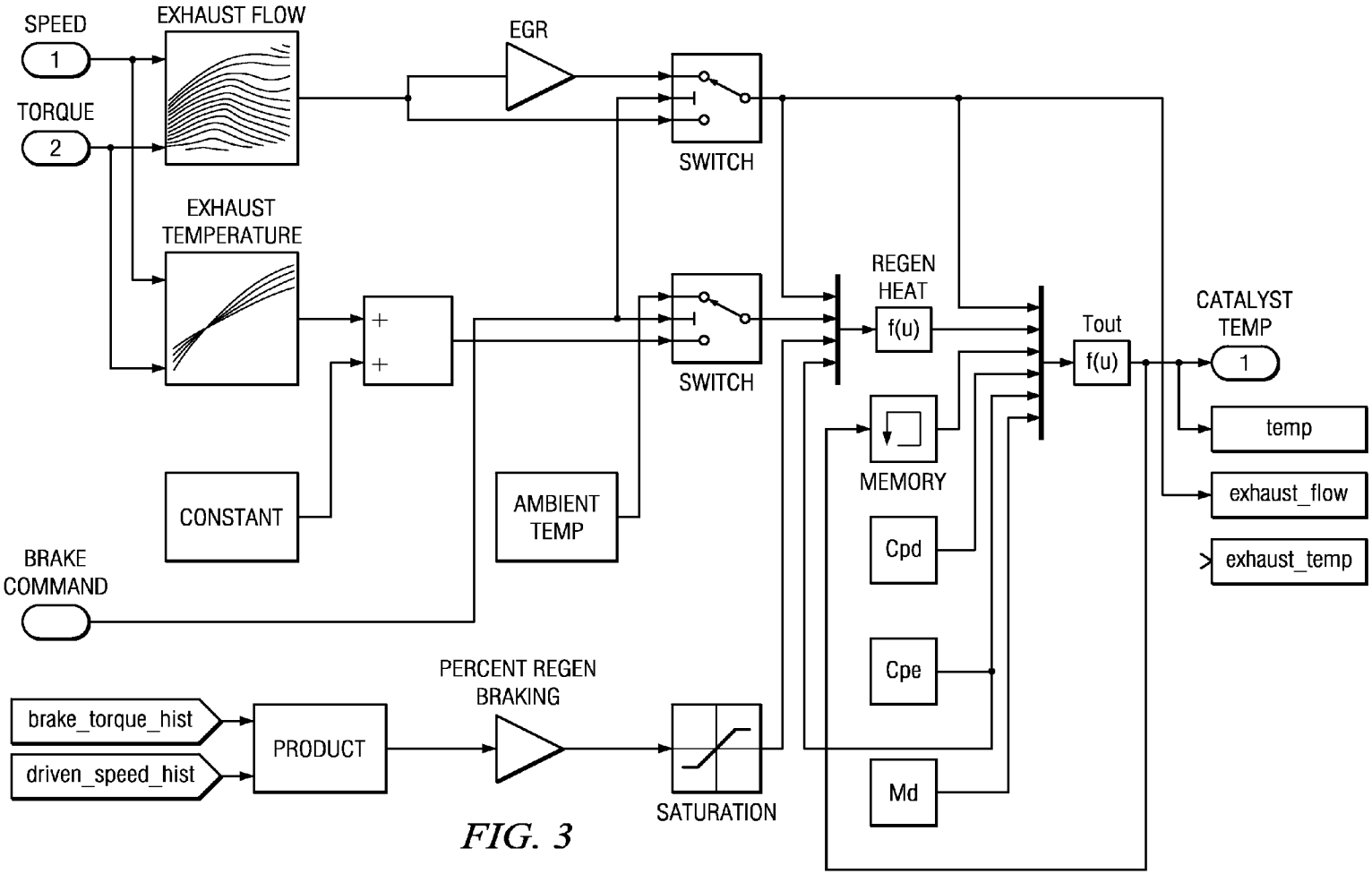
FIG. 3 illustrates a computer-implemented model of an urban bus, whose operation may be simulated using appropriate software.

FIG. 3 illustrates a computer-implemented model of an urban bus, whose operation may be simulated using appropriate software. An example of suitable modeling software is VPSET (vehicle powertrain systems evaluation tool), a vehicle modeling and simulation software conventionally used to analyze performance and fuel economy of powertrains.

A DPF temperature model was developed and integrated into the vehicle model. The DPF model was simplified, but produced reasonable results.

Figure 4:
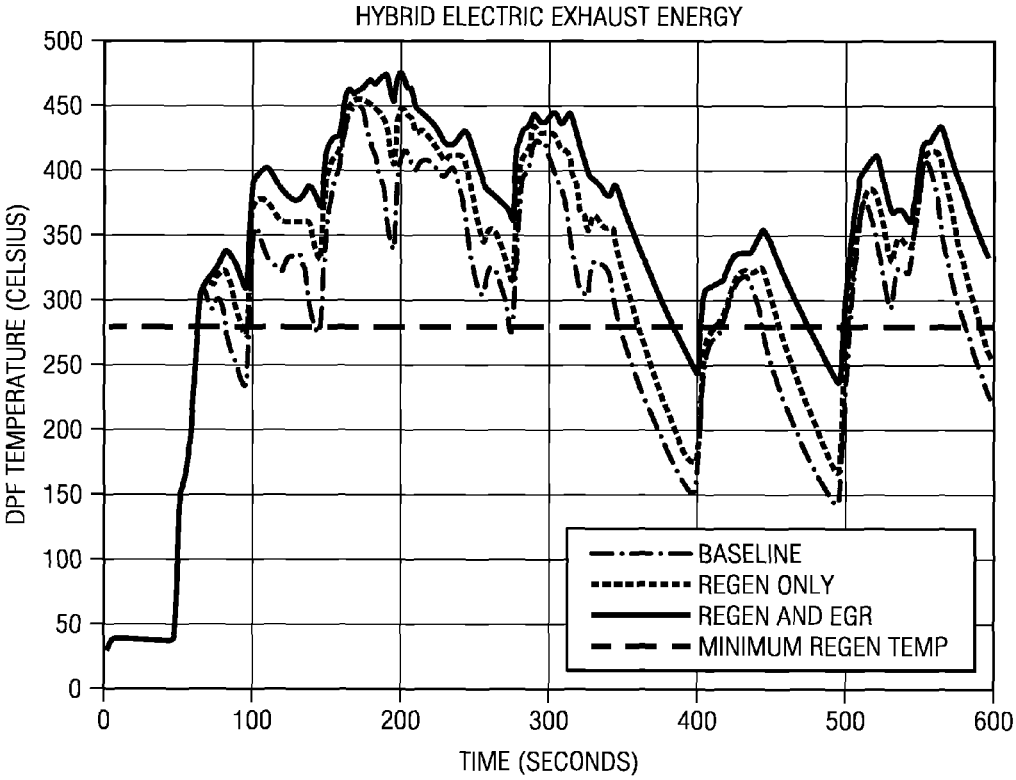
FIG. 4 illustrates the results of simulated operation of a bus, using the model of FIG. 3.

FIG. 4 illustrates the results of simulated operation of a bus, using the model of FIG. 3. Over time, the temperature of the DPF was recorded. The bus was operated, by simulation, over the NYCC to obtain a "baseline" DPF temperature. The model was then modified to assume that 50% of the braking energy could be captured and converted to heat using an electric generator and a metal substrate configured to be an EHC. The power was then limited to 20 kW (assuming a 20 kW electric generator is to be used), and the cycle was rerun. Then the model was rerun with regenerative energy recapture and EGR.

The dashed line in FIG. 4 indicates the minimum temperature for regeneration of a DPF. As illustrated, an increase in exhaust gas temperature was realized from the use of braking energy for heating the exhaust. An even better increase was realized by using both braking energy and EGR.

Figure 5:
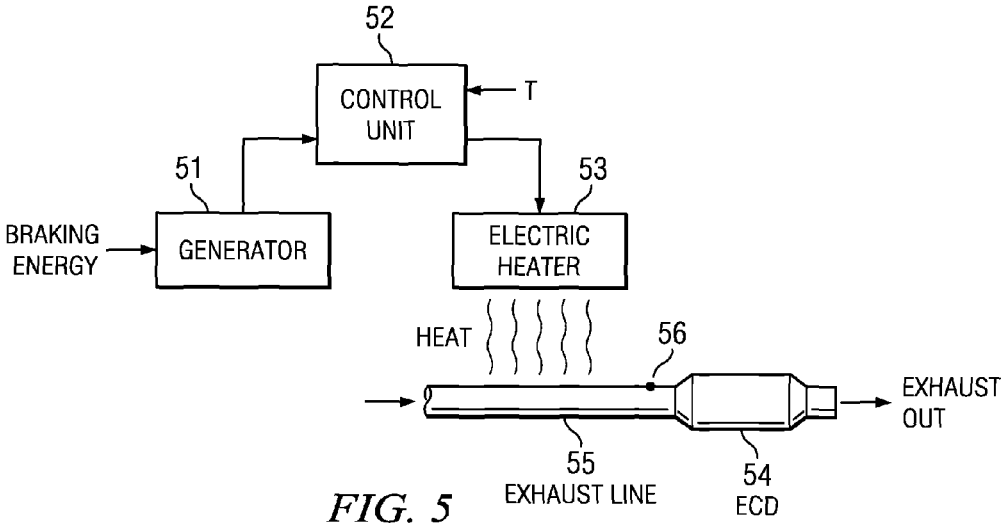
FIG. 5 illustrates a system for using vehicle braking energy to heat exhaust gas.

FIG. 5 illustrates the relevant elements of a vehicle having an exhaust system with captured braking energy in accordance with the methods described herein. In this embodiment, the heat is applied to the exhaust gas directly in front of the input to an emission control device (ECD) 54. The ECD 54 may be any catalyzed or uncatalyzed exhaust aftertreatment device, whose operation requires or is improved by being heated. The heating may be required continuously or periodically such as for regeneration.

A generator 51 converts the mechanical energy of braking into electrical energy. Methods and devices similar to those used for regenerative braking in electric and hybrid vehicles can be used to convert the mechanical motion of the wheels during braking into electrical energy. The vehicle's existing alternator could be used for this purpose, perhaps slightly scaled up in output.

The electrical energy is delivered directly to the heater 53. Heater 53 may be implemented with various types of heaters, including ambient (outside the exhaust line) or in-exhaust type heaters. Heater 53 heats the exhaust prior to the input to an emissions control device (EDC) 54. Thus, the heat is applied to the exhaust gas in the exhaust line 55 at the input to the EDC 54. Although not explicitly shown, heater 53 may be implemented so that the heating element surrounds the exhaust line so as to evenly apply heat.

If heat is to be applied in a controlled manner, control unit 52 may be used to regulate and otherwise control the flow of electrical energy to heater 53. Control unit 52 may be implemented with simple electronics, or may be a more sophisticated device. For example, control unit 52 may be processor-based and programmed with various temperature control strategies. Control strategies may include maintaining a desired temperature or temperature range, or providing temperature excursions at predetermined times for precise regeneration events. A temperature measurement device 56 may be used at the input to the EDC, or in the EDC itself, to provide temperature data to the control unit 52.

Figure 6:
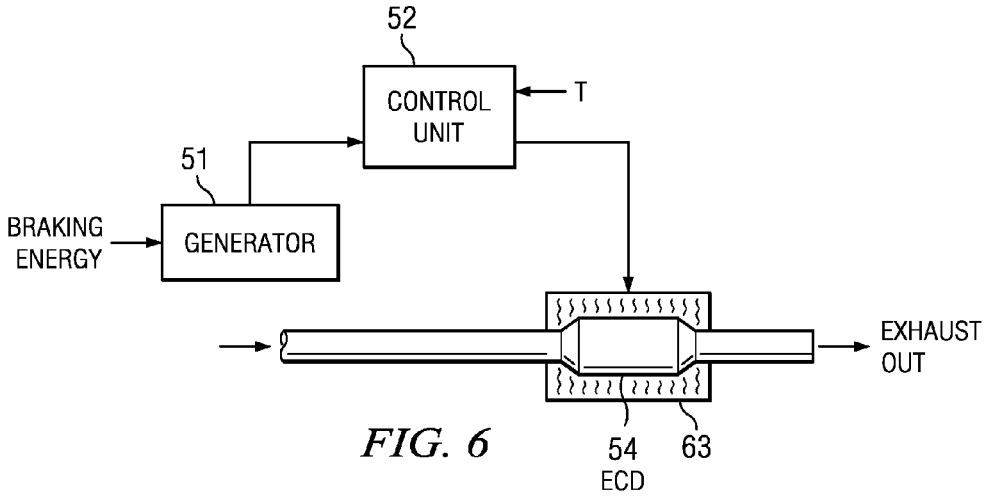
FIG. 6 illustrates a system for using vehicle braking energy to heat an emissions control device.

FIG. 6 illustrates an alternative embodiment in which the heat is applied directly to the ECD 54. Heater 63 is installed around the ECD 54 so as to evenly apply heat to the device.

Figure 7:
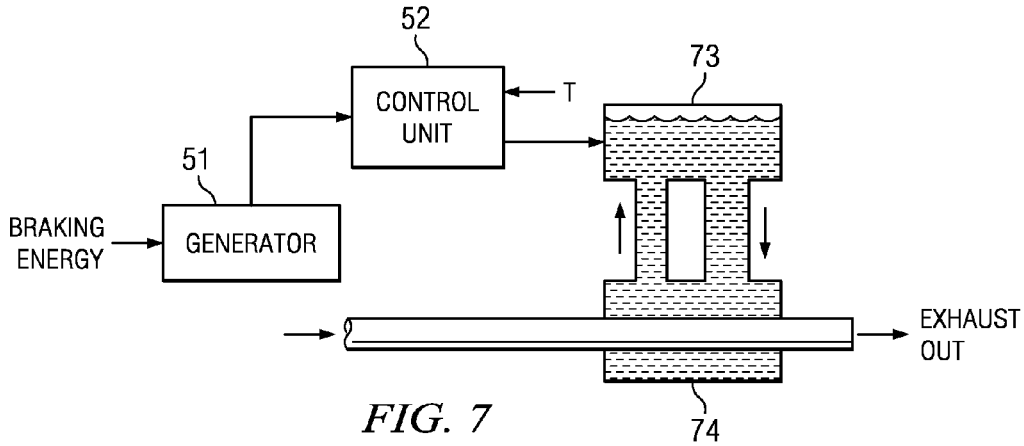
FIG. 7 a system for using vehicle braking energy to heat a thermal storage material, so that the material can be used to heat exhaust gas or an emissions control device.

FIG. 7 illustrates another alternative embodiment in which the heater is a thermal storage heater 73, having an associated reservoir for thermal storage. An example of a suitable heater of this type is one that heats an insulated thermal storage material such as molten salt. When heat is needed for ECD operation, the material is circulated in a heat exchange chamber 74, which surrounds either the exhaust line or the ECD to heat the exhaust gas or the ECD directly.

Figure 8:
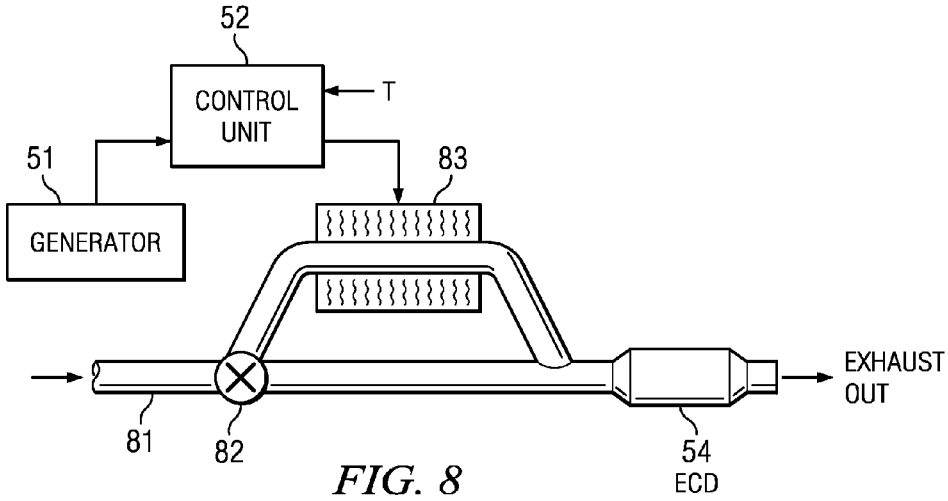
FIG. 8 illustrates a system for using vehicle braking energy to heat exhaust gas or an emissions control device on a branch of a bifurcated exhaust line.

FIG. 8 illustrates another alternative embodiment in which heater 83 incorporates heat storage in the form of a metal or other solid material that stores heat. The exhaust line 81 is bifurcated, such that when heat is needed for ECD operation, the exhaust is routed via valve 82 to one branch of the bifurcated exhaust line, which applies heat to the exhaust. If the exhaust is already sufficiently hot for proper ECD operation, the exhaust travels directly to the ECD.

Because the method transfers energy from regenerative braking to exhaust energy, the system does not require batteries or other electrical energy storage devices. More specifically, no ultra-capacitors or battery packs are required. Also, because the method does not augment driving energy, no special drive motors or controllers are required.

What is claimed is:

1. A method of raising the operating temperature of an emissions control device installed on a vehicle exhaust line, comprising:

using a generator to convert mechanical braking energy generated by the vehicle to electrical energy;

delivering the electrical energy to a thermal storage reservoir containing a thermal storage material;

determining whether the operating temperature of the emissions control device is below a threshold temperature needed for desired operation;

if the operating temperature is below the threshold temperature, circulating the thermal storage material to and within a heat exchange chamber operable to raise the operating temperature of the emissions control device.

2. The method of claim 1, wherein the generator is an existing alternator of the vehicle.

3. The method of claim 1, further comprising using a control unit to maintain the exhaust gas temperature within a predetermined temperature range.

4. The method of claim 1, further comprising using a control unit to provide temperature excursions for regenerating the emissions control device.

5. A system for of raising the operating temperature of an emissions control device installed on a vehicle exhaust line, comprising:

a generator operable to convert mechanical braking energy generated by the vehicle to electrical energy;

a thermal storage reservoir containing a thermal storage material;

a heat exchange chamber in fluid communication with the reservoir and operable to raise the operating temperature of the emissions control device, regardless of whether electrical energy is currently being generated, by circulating the thermal storage material;

a control unit configured to determine whether the operating temperature of the emissions control device is below a threshold temperature needed for desired operation, and if the operating temperature is below the threshold temperature, to generate a control signal to actuate circulation of the thermal storage material.

6. The system of claim 5, wherein the generator is an existing alternator of the vehicle.

7. The system of claim 5, wherein the control unit is configured to maintain the exhaust gas temperature within a predetermined temperature range.

8. The system of claim 5, wherein the control unit is configured to provide temperature excursions for regenerating the emissions control device.

9. The system of claim 5, wherein the exhaust line is bifurcated and the heat exchange chamber heater is located on a branch of the bifurcated exhaust line.

* * * * *